US007132986B2

(12) United States Patent
Inatsugu et al.

(10) Patent No.: US 7,132,986 B2
(45) Date of Patent: Nov. 7, 2006

(54) ANTENNA DEVICE

(75) Inventors: Susumu Inatsugu, Hirakata (JP); Takeshi Masutani, Moriguchi (JP); Kazuhiko Fujikawa, Kyotanabe (JP); Masami Segawa, Izumi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/153,799

(22) Filed: Jun. 15, 2005

(65) Prior Publication Data

US 2006/0017619 A1 Jan. 26, 2006

(30) Foreign Application Priority Data

Jul. 8, 2004 (JP) ..... 2004-201515
Feb. 9, 2005 (JP) ..... 2005-032547

(51) Int. Cl.
*H01Q 1/38* (2006.01)
*H01Q 9/28* (2006.01)
*H01Q 21/00* (2006.01)

(52) U.S. Cl. ..... 343/700 MS; 343/795; 343/810

(58) Field of Classification Search ..... 343/700 MS, 343/748, 788, 795, 804, 810, 824, 829, 846, 343/866

See application file for complete search history.

(56) References Cited

U.S. PATENT DOCUMENTS 3,573,831 A * 4/1971 Forbes ..... 343/705
4,183,027 A * 1/1980 Ehrenspeck ..... 343/726
5,420,599 A * 5/1995 Erkocevic ..... 343/828
5,453,752 A * 9/1995 Wang et al. ..... 343/700 MS
5,557,293 A * 9/1996 McCoy et al. ..... 343/867
5,563,616 A * 10/1996 Dempsey et al. ..... 343/753
5,760,747 A 6/1998 McCoy et al.
6,703,984 B1 * 3/2004 Schadler ..... 343/770
6,734,825 B1 * 5/2004 Guo et al. ..... 343/700 MS
2003/0098812 A1 * 5/2003 Ying et al. ..... 343/702
2003/0142022 A1 * 7/2003 Ollikainen et al. ..... 343/702
2003/0146874 A1 * 8/2003 Kane et al. ..... 343/702
2003/0189519 A1 10/2003 Rutfors et al.
2004/0095282 A1 * 5/2004 Fukushima et al. ..... 343/702
2004/0212541 A1 * 10/2004 Apostolos et al. ..... 343/742
2005/0195124 A1 * 9/2005 Puente Baliarda et al. . 343/893

FOREIGN PATENT DOCUMENTS

EP 0 590 955 A2 9/1993
JP 09-232858 A 9/1997
JP 11-261335 9/1999
JP 2003-347822 A 12/2003

OTHER PUBLICATIONS

Search Report under Section 17 for Application No. GB 0511171.1, dated Aug. 31, 2005.

* cited by examiner

*Primary Examiner*—Don Wong
*Assistant Examiner*—Marie Antoinette Cabucos
(74) *Attorney, Agent, or Firm*—RatnerPrestia

(57) ABSTRACT

An antenna element includes a conductive ground plane, planar first and second antenna elements, and feeding points. The first antenna element confronts the ground plane at a given interval, and the second antenna element surrounds parts of the outer periphery of the first antenna element at a certain interval. Each one of the feeding points is provided to the first and the second antenna elements for feeding high-frequency signals to those elements. The foregoing construction allows achieving a compact antenna device that can perform a polarization diversity communication.

3 Claims, 6 Drawing Sheets

ANTENNA DEVICE

FIELD OF THE INVENTION

The present invention relates to antenna devices to be used in on-vehicle mobile radio apparatuses such as automobile telephone systems.

BACKGROUND OF THE INVENTION

Antenna devices for automobile telephone systems have been recently demanded to perform a good quality communication (hereinafter referred to as a "diversity communication") anytime regardless of automobile's running position or a running direction.

An automobile telephone system often encounters disturbances of radio-wave because the radio-wave is reflected or refracted by high-rise buildings when the automobile runs in an urban area. A polarization diversity communication has been devised as a communication method for maintaining communication quality even if radio-wave is subjected to the disturbance. The polarization diversity communication carries out a communication by selecting whichever a stronger polarization signal from vertical radio-wave (vertically polarized wave) and horizontal radio-wave (horizontally polarized wave).

The antenna device used for the polarization diversity communication thus includes a vertically polarized antenna element and a horizontally polarized antenna element, so that the antenna device can carry out communications in every direction of the automobile.

The conventional antenna device discussed above is described hereinafter with reference to FIG. 7, which shows a perspective view of the conventional antenna device. In FIG. 7, at the center of planar conductive ground plane 52, linear first antenna element 53 (hereinafter referred to as "element 53") stands upright with the height of H1. At the lower end of element 53, feeding point 53*a* is provided for feeding high-frequency signals extending through ground plane 52.

At an end portion of ground plane 52, linear or planar second antenna elements 54 (hereinafter referred to as "elements 54") are placed in parallel with ground plane 52. Feeding points 54*a* are provided to the respective ends of elements 54 adjacent to each other, and high-frequency signals are fed through signal lines 54*b* to feeding points 54*a*. Signal lines 54*b* extend through ground plane 52 and confront each other with a space in between.

Elements 54 are extended to both sides from feeding points 54*a* by the length of L1. The height of H1 of element 53 and the length of L1 of elements 54 correspond to ¼ wavelength of their operating frequencies respectively. Antenna device 51 incorporates element 53 and elements 54.

As shown in FIG. 7, a direction of radio-wave transmitted to/from antenna device 51 is defined based on ground plane 52 as X-direction, and Y-, Z-directions are defined accordingly. In this construction, element 53 works as vertically polarized wave antenna element which transmits/receives vertically polarized wave "Fa", and elements 54 work as horizontally polarized wave antenna elements which transmit/receive horizontally polarized wave "Fb". Antenna device 51 selects whichever a stronger polarized-wave signal from waves Fa and Fb for performing a communication. A conventional antenna device such as device 51 discussed above is disclosed in, e.g. Japanese Patent Application Unexamined Publication No. H11-261335.

SUMMARY OF THE INVENTION

An antenna device of the present invention has a conductive ground plane, a planar first antenna element, a second antenna element, and feeding points. The first antenna element confronts the ground plane at a given interval, and the second antenna element is placed at a certain interval from the first antenna element, and surrounds parts of the outer periphery of the first antenna element. The feeding points are provided to the first antenna element and the second antenna element respectively for feeding high-frequency signals to the first and the second antenna elements. This construction allows achieving a compact antenna device that can perform a polarization diversity communication.

DETAILED DESCRIPTION OF PREFERRED EMBODIMENTS

Exemplary embodiments of the present invention are demonstrated hereinafter with reference to FIG. 1–FIG. 6.

Exemplary Embodiment 1

Figure 1A:
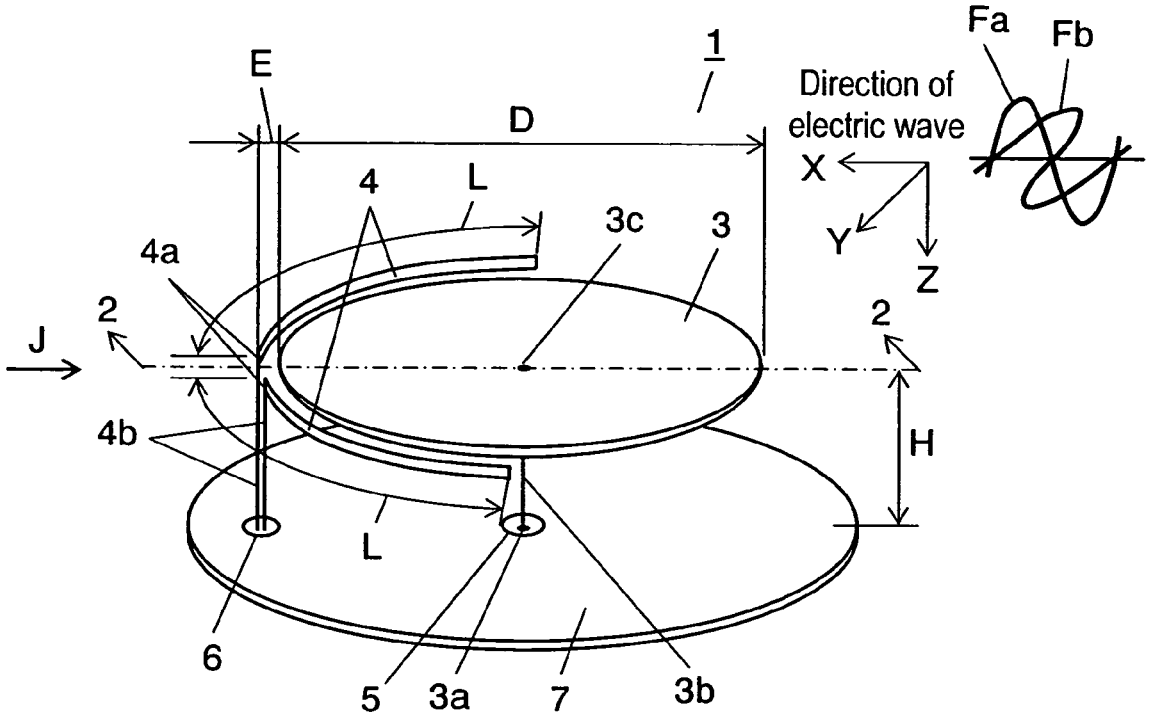
FIG. 1A shows a perspective view illustrating an antenna device in accordance with a first exemplary embodiment of the present invention.
Figure 1B:
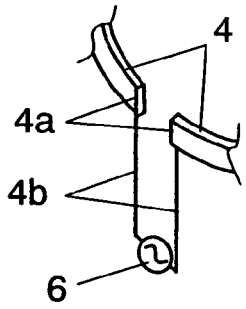
FIG. 1B shows a partially enlarged perspective view illustrating the antenna device shown in FIG. 1A.
Figure 2:
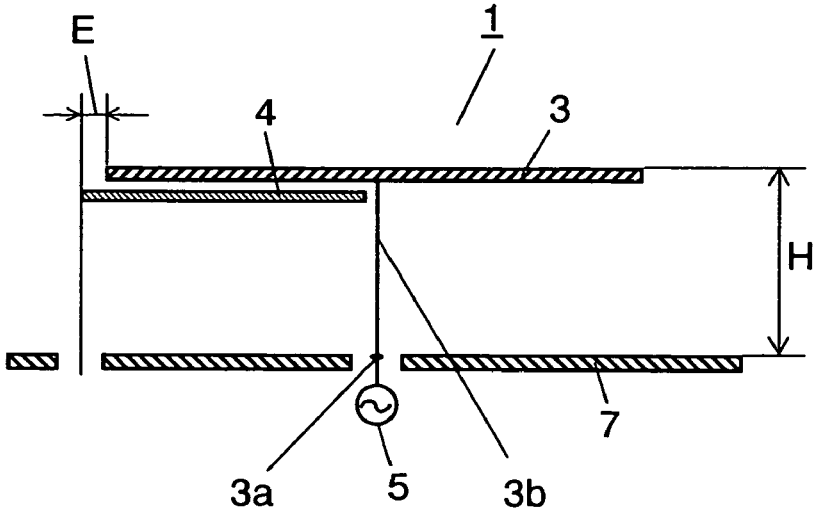
FIG. 2 shows a sectional view of the antenna device shown in FIG. 1 taken along line 2—2.

FIG. 1A shows a perspective view illustrating an antenna device in accordance with the first exemplary embodiment of the present invention, and FIG. 1B shows a partially enlarged perspective view illustrating the antenna device shown in FIG. 1A. FIG. 2 shows a sectional view of the antenna device shown in FIG. 1A taken along line 2—2. Disc-shaped planar conductive ground plane 7 shown in FIGS. 1 and 2 is made of good conductive material such as copper, copper alloy metal, or aluminum alloy metal. First antenna element 3 (hereinafter referred to as "element 3") confronts ground plane 7 at given interval H. Element 3 is made of good conductive material like ground plane 7, and shaped like a planar disc having diameter "D". Element 3 includes coupling point 3*c* at its center, and feeding point 3*a* feeds high-frequency signal 5 to coupling point 3*c* via feeding pin 3*b* extending through ground plane 7.

Two second antenna elements 4 (hereinafter referred to as "elements 4") surround parts of the outer periphery of element 3 at a certain interval of E, so that elements 4 are placed like letter U. Elements 4 are made of good conductive material like ground plane 7 and element 3, and shaped linear or planar. Elements 4 have feeding points 4*a* respectively at their ends adjacent to each other. Feeding points 4*a* are fed with high-frequency signal 6 via signal lines 4*b* extending through ground plane 7 and confronting each other with a space in between.

Elements 4 are extended to both sides by the length "L" from the respective feeding points 4*a*. The summated length of height H and diameter D of element 3 corresponds to ¼ wavelength of an operating frequency of element 3. Length L of elements 4 corresponds to ¼ wavelength of an operating frequency of elements 4. Antenna device 1 incorporates element 3 and elements 4.

As shown in FIG. 1A, a direction of radio-wave transmitted to/from antenna device 1 is defined based on ground plane 7 as X-direction, and Y-, Z-directions are defined accordingly. Element 3 and feeding pin 3*b* work as an antenna element for transmitting/receiving the vertically polarized wave "Fa" excited and perpendicular to X-Y plane. Elements 4 work as an antenna element for transmitting/receiving the horizontally polarized wave "Fb" excited and in parallel with X-Y plane.

Antenna device 1 thus can perform the polarization diversity communication by selecting whichever the stronger polarized signal from waves "Fa" and "Fb", so that the foregoing construction allows antenna device 1 to perform a communication using radio-waves along any direction of X, Y, or Z. In other words, antenna device 1 can perform omnidirectional communications.

As discussed above, element 3 confronts ground plane 7, and elements 4 surround certain parts of the outer periphery of element 3 at a certain space in between. This construction allows antenna device 1 to be lower-height and to limit its planar size within that of ground plane 7, so that antenna device 1 can be downsized.

Exemplary Embodiment 2

The second embodiment is demonstrated hereinafter with reference to FIG. 3. Structural elements similar to those of the first embodiment have the same reference marks and the detailed descriptions thereof are omitted here.

In the first embodiment, ground plane 7 and element 3 are shaped like a planar disc, and elements 4 shaped like letter U; however, the present invention is not limited to this structure, so that another example is described below.

Figure 3:
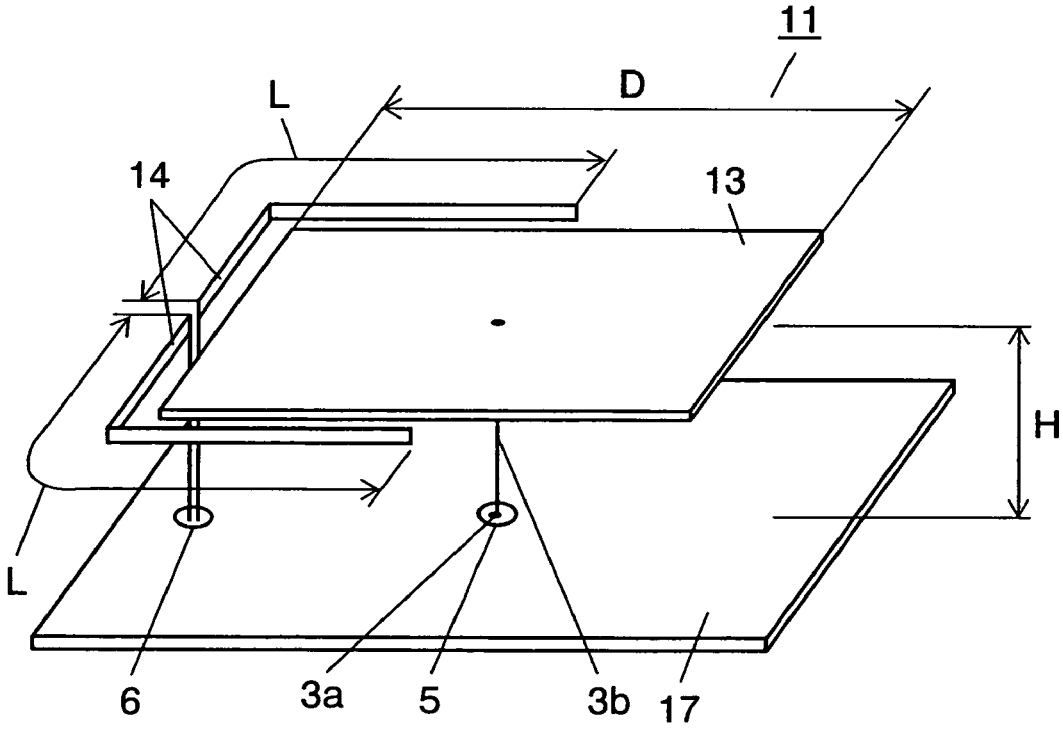
FIG. 3 shows a perspective view of an antenna device in accordance with a second exemplary embodiment of the present invention.

FIG. 3 shows a perspective view illustrating an antenna device in accordance with the second embodiment. In FIG. 3, antenna device 11 includes conductive ground plane 17, first antenna element 13 (hereinafter referred to as "element 13") and second antenna elements 14 (hereinafter referred to as "elements 14"). Ground plane 17 and element 13 are shaped like a planar rectangle. Elements 4 are formed of two elements each shaped like letter "L", and the two letters "L" are combined to be a letter "U" having angular corners. The summated length of height "H" and width "D" of element 13 corresponds to ¼ wavelength of an operating frequency of element 13. Length L of elements 14 corresponds to ¼ wavelength of an operating frequency of elements 14. This construction allows antenna device 11 to perform similarly and produce an advantage similar to that of antenna device 1 demonstrated in the first embodiment.

Exemplary Embodiment 3

Figure 4:
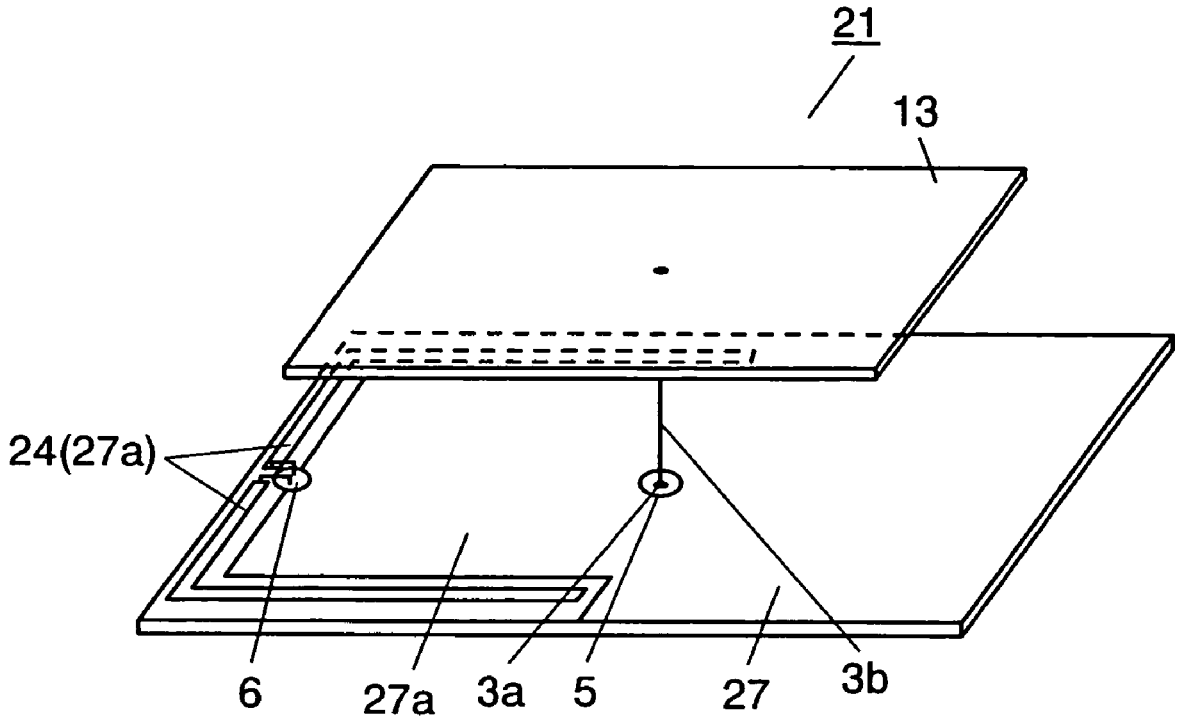
FIG. 4 shows a perspective view of an antenna device in accordance with a third exemplary embodiment of the present invention.

The third embodiment is demonstrated with reference to FIG. 4. Structural elements similar to those of the first and the second embodiments have the same reference marks and the detailed descriptions thereof are omitted here.

The first embodiment demonstrates elements 3 and 4 are coplanar, and the second embodiment demonstrates elements 13 and 14 are also placed on one plane; however, the present invention is not limited to those constructions. For instance, second antenna elements 4, 14 can be placed between ground planes 7, 17 and first antenna elements 3, 13.

FIG. 4 shows a perspective view illustrating an antenna device in accordance with the third embodiment. As shown in FIG. 4, antenna device 21 includes second antenna elements 24 (hereinafter referred to as "elements 24") and conductive ground plane 27 both formed on one plane. Elements 24 are formed by using parts of conductor 27*a* on which ground plane 27 is formed. This construction allows antenna device 21 to perform similarly and produce an advantage similar to those demonstrated in the first and the second embodiments.

On top of that, the foregoing construction eliminates components for forming elements 24, thereby reducing the manufacturing cost, which is an additional advantage. Elements 24 are not necessarily to share the same plane with ground plane 27, and element 24 can be placed between element 13 and ground plane 27 with a work and an advantage similar to those discussed above.

Exemplary Embodiment 4

Figure 5A:
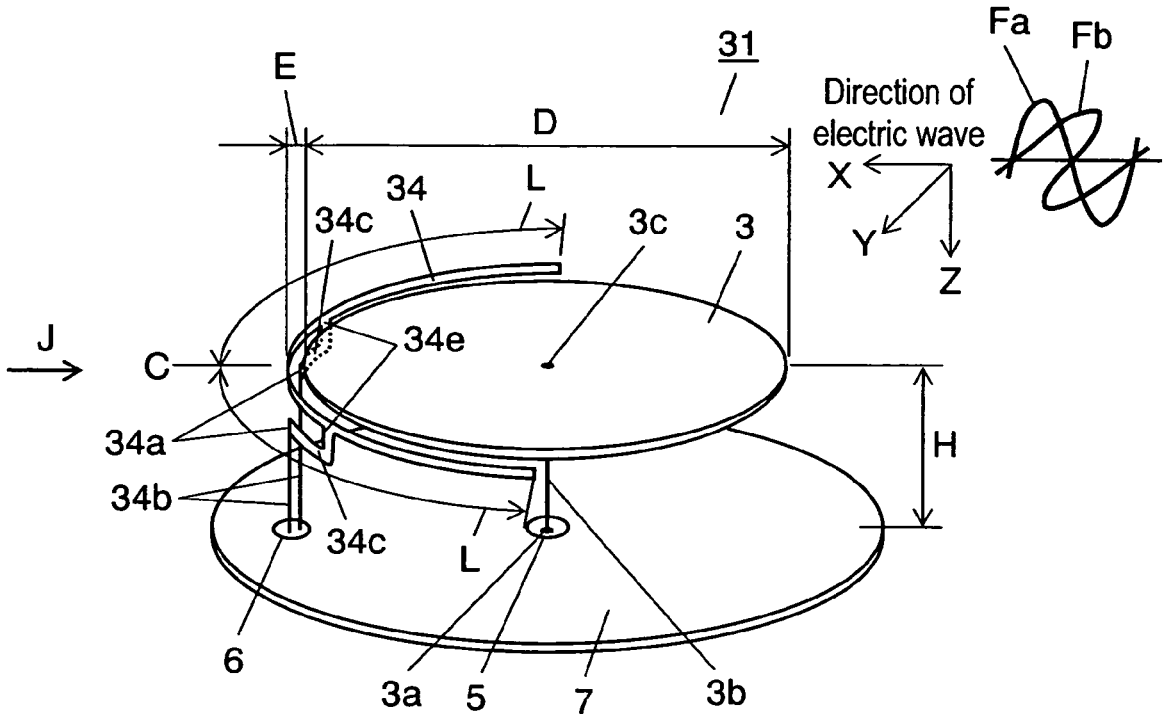
FIG. 5A shows a perspective view of an antenna device in accordance with a fourth exemplary embodiment of the present invention.
Figure 5B:
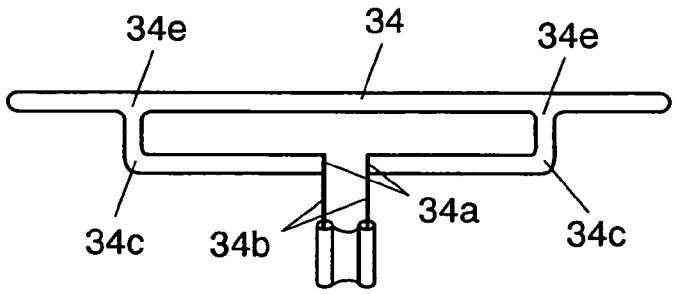
FIG. 5B shows a partially enlarged development drawing of the antenna device shown in FIG. 5A viewed along arrow mark "J".

The fourth embodiment is demonstrated with reference to FIGS. 5A and 5B. Structural elements similar to those of the first through the third embodiments have the same reference marks, and the detailed descriptions thereof are omitted here.

In the first through the third embodiments, two second antenna elements 4, 14 and 24 are used; however, the second antenna element does not always need two antenna elements, and a single antenna element can work as the second antenna element.

FIG. 5A shows a perspective view illustrating an antenna device in accordance with the fourth embodiment, and FIG. 5B shows a partially enlarged development of the antenna device shown in FIG. 5A viewed along arrow mark J. As shown in FIGS. 5A and 5B, antenna device 31 includes second antenna element 34 (hereinafter referred to as "element 34") formed of a single element. Element 34 has two branch points 34*e* respectively apart from its center C, and connecting lines 34*c* extend downward linearly and perpendicularly from branch points 34*e*. Each one of connecting lines 34*c* is bent at approx. right angles and reaches feeding point 34*a*, to which high-frequency signals 6 are fed via relay-line 34*b*. Length "L" of element 34 from center "C" corresponds to ¼ wavelength of the operating frequency of element 34.

Two connecting lines 34*c* are used for impedance matching of element 34. Mismatching of impedance between high-frequency signal 6 and element 34 requires changing a length or a bent point of each one of connecting lines 34*c* for matching the impedance. Connecting line 34*c* thus changes its own impedance, thereby matching the impedance of element 34.

Exemplary Embodiment 5

Figure 6A:
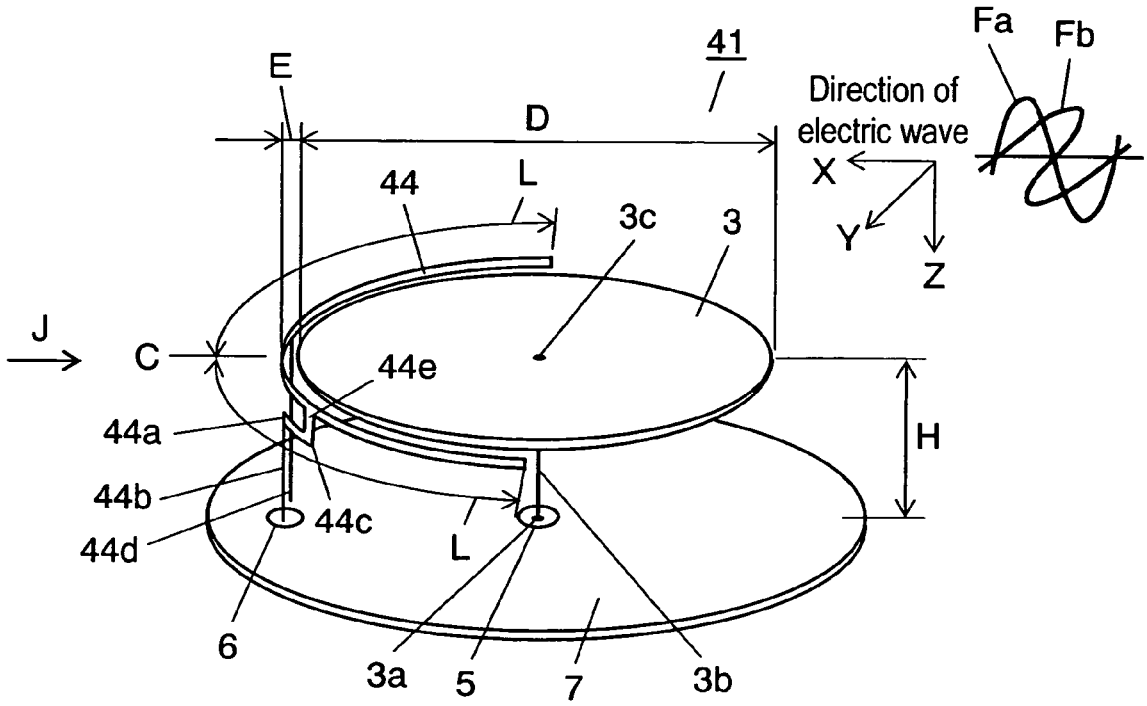
FIG. 6A shows a perspective view illustrating an antenna device in accordance with a fifth exemplary embodiment of the present invention.
Figure 6B:
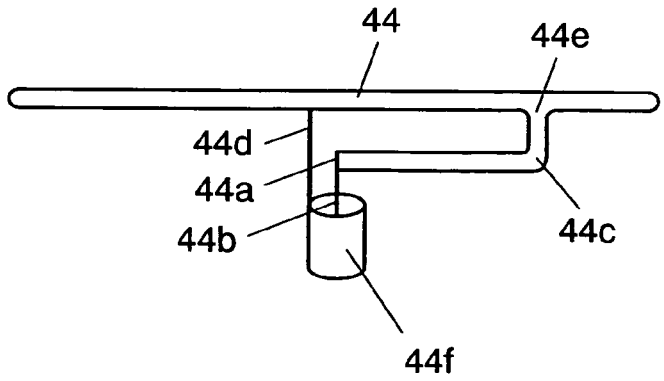
FIG. 6B shows a partially enlarged development drawing of the antenna device shown in FIG. 6A viewed along arrow mark "J".
Figure 7:
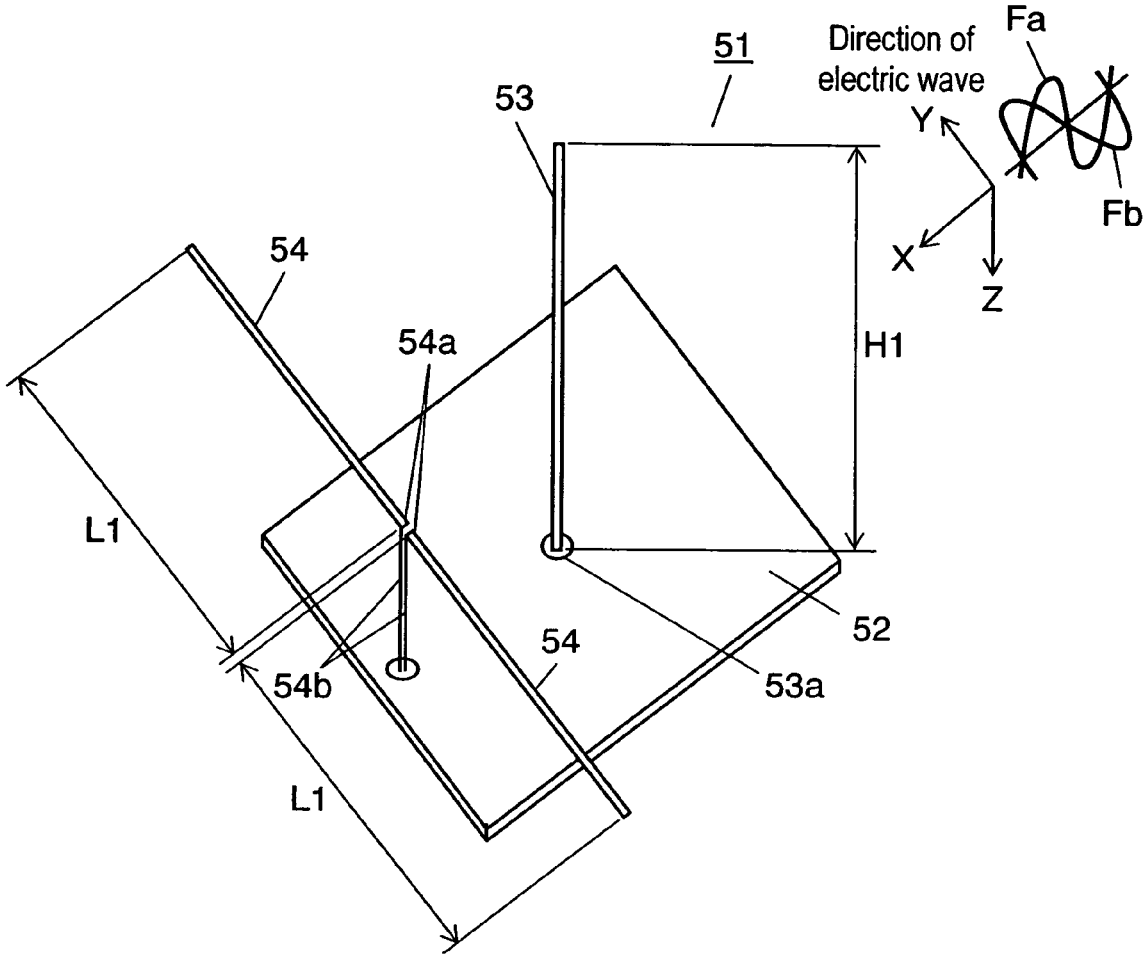
FIG. 7 PRIOR ART
FIG. 7 shows a perspective view illustrating a conventional antenna device.

The fifth embodiment is demonstrated with reference to FIGS. 6A and 6B. Structural elements similar to those of the first through the fourth embodiments have the same reference marks and the detailed descriptions thereof are omitted here.

FIG. 6A shows a perspective view illustrating an antenna device in accordance with the fifth embodiment, and FIG. 6B shows a partially enlarged development of the antenna device shown in FIG. 6A viewed along arrow mark J. The construction shown in FIGS. 6A and 6B can be used as an instance of impedance matching. Antenna device 41 shown in FIGS. 6A and 6B includes second antenna element 44 (hereinafter referred to as "element 44") formed of a single element. Element 44 has one branch point 44*e* apart from its center C. Connecting line 44*c* extends downward linearly and perpendicularly from branch point 44*e*. Connecting line 44*c* is bent at approx. right angles and reaches feeding point 44*a*, to which high-frequency signals 6 are fed via signal line 44*b*. Length "L" of element 44 from center "C" corresponds to ¼ wavelength of the operating frequency of element 44.

From center C of element 44, shorting pin 44*d* extending to ground plane 7 is provided independent of connecting line 44*c*. The impedance matching of element 44 is achieved by shorting pin 44*d* and connecting line 44*c*. The second antenna element formed of a single element can work similarly and produce an advantage similar to those demonstrated in embodiments 1 through 4.

Signal lines 4*b* shown in FIG. 1 through FIG. 5 usually uses two lines, so that a parallel cable is employed in general. However, the construction shown in FIGS. 6A and 6B can replace the two signal lines (signal line 44*b* and shorting pin 44*d*) with one coaxial cable 44*f*. On top of that, since element 44 and connecting line 44*c* can be made of the same material, they can be integrally formed by a pressing or etching method. As a result, the manufacturing steps can be simplified.

What is claimed is:

1. An antenna device comprising:

a conductive ground plane;

a first antenna element having a plane-shape and confronting the ground plane at a given interval;

a plurality of second antenna elements surrounding a part of the first antenna element; and feeding points provided to the first antenna element and the second antenna elements respectively for feeding a high-frequency signal to the first and the second antenna elements;

said plurality of second antenna elements are a mirror image of each other about an axis line extending through a center of the first antenna element.

2. The antenna device of claim 1, wherein the second antenna element is formed between the ground plane and the first antenna element.

3. The antenna device of claim 1, wherein the second antenna element and the ground plane are formed on one plane.

* * * * *